United States Patent [19]

Roy

[11] Patent Number: 4,824,112

[45] Date of Patent: Apr. 25, 1989

[54] THREE-DIMENSIONAL PUZZLE BUILDING

[76] Inventor: Ray Roy, 120 Chester St., Lawrence, Mass. 01843

[21] Appl. No.: 46,291

[22] Filed: May 4, 1987

[51] Int. Cl.[4] ..... A63F 9/12

[52] U.S. Cl. ..... 273/157 R; 446/110

[58] Field of Search ..... 273/157 R; 446/110

[56] References Cited

U.S. PATENT DOCUMENTS

| | | | |
|---|---|---|---|
| 294,589 | 3/1884 | Crandall | 273/157 R |
| T984,007 | 7/1979 | Richardson | 273/157 R |
| 1,211,590 | 1/1917 | Kennedy | 273/157 R X |
| 1,964,007 | 6/1934 | Parks | 273/157 R |
| 1,975,926 | 10/1934 | Corbin, Jr. et al. | 273/157 R X |
| 1,976,664 | 10/1934 | Gantt | 273/157 R |
| 2,011,058 | 8/1935 | Krase | 273/157 R |
| 2,077,065 | 4/1937 | Johannes . | |
| 2,569,107 | 9/1951 | Johnson | 273/157 R X |
| 2,780,028 | 2/1957 | McNeill | 446/110 |
| 2,871,619 | 2/1959 | Walters . | |
| 2,951,312 | 9/1960 | Engh . | |
| 3,137,967 | 6/1964 | Flieth | 273/157 R X |
| 3,485,496 | 12/1969 | Brunton | 273/157 R |
| 3,548,552 | 12/1970 | McBride . | |
| 3,578,331 | 5/1971 | DeGast | 273/157 R |
| 3,692,312 | 9/1972 | Meyer | 273/157 R |
| 3,701,214 | 10/1972 | Sakamoto | 273/160 X |
| 3,774,357 | 11/1973 | Moore . | |
| 4,235,039 | 11/1980 | Brooks | 273/157 R X |
| 4,323,245 | 4/1982 | Beaman | 273/157 R |
| 4,358,115 | 11/1982 | Haas | 273/157 R |
| 4,469,331 | 9/1984 | Rinker | 273/157 R |

FOREIGN PATENT DOCUMENTS

| | | | |
|---|---|---|---|
| 100283 | 2/1937 | Australia | 446/110 |
| GM7912237 | 3/1980 | Fed. Rep. of Germany | 273/157 R |
| 419311 | 11/1934 | United Kingdom | 273/157 R |
| 2068743 | 8/1981 | United Kingdom | 273/157 R |

*Primary Examiner*—Anton O. Oechsle

*Attorney, Agent, or Firm*—Weingarten, Schurgin, Gagnebin & Hayes

[57] ABSTRACT

The invention discloses a house or other structure defining an enclosure whose walls are constituted as multiple puzzle pieces. The disclosure extends to any sculpture-like three-dimensional puzzle where the walls defining the sculpture or structure are composed of self-standable puzzle-pieces, and the sculpture or structure is itself self-standing.

14 Claims, 4 Drawing Sheets

THREE-DIMENSIONAL PUZZLE BUILDING

FIELD OF THE INVENTION

This invention is directed to the field of puzzle devices, and more particularly, to a novel puzzle building.

BACKGROUND OF THE INVENTION

Jigsaw puzzles usually include plural two-dimensional puzzle pieces each having a different and unique portion of an overall image. In the typical case, the several puzzle pieces are in a random order, and the puzzle is "solved" by individually gathering the several pieces in side by side interlocking relation successively until all of the pieces are formed into an interfitting whole. During the solution process with each piece addition the image appears more fully until the entire image is present before ones eyes. The solution activity is rewarded in the self satisfaction of successfully meeting the challenge of being able to consistently discover the correct next piece, sometimes out of thousands of pieces, and in the mutual satisfaction that arises from the solution activity when it is shared with one or more others. Other advantages and benefits of ordinary jigsaw puzzle puzzles are known to those skilled in the art.

SUMMARY OF THE INVENTION

The present invention provides a free-standing three-dimensional jigsaw structure that represents an intensification and an extension of the heretofore known two-dimensional jigsaw structures. In accordance therewith, a novel three-dimensional jigsaw structure is disclosed that is able to be spacially experienced, in addition to being merely seen as in the prior two-dimensional puzzle devices. The satisfaction that belongs to the solution activity of the present invention is thus not only greater in a quantitative sense than that available from ordinary two-dimensional puzzles but also supercedes it insofar as qualitatively the present invention first makes possible an entirely new three-dimensional jigsaw spacial experience.

The present invention presents the possibility to view the self-standing three-dimensional object constructed in accordance therewith from any perspective, including front, to the side, from the rear, and above, and further presents the possibility to go into its inside, as in the case of a playhouse or fortress. Many different structures including churches, temples, office buildings, historic sites, and many three-dimensional self standing objects other than buildings, are capable of being simulated as a three-dimensional puzzle in accordance with the present invention.

The three-dimensional puzzle structure of the present invention includes one or more constitutive walls having outside and inside surfaces and defining an enclosure. An image of an intended structure to be simulated is provided on the outside surface of at least some of the constitutive walls. At least some of the walls are constituted from multiple interfitting jigsaw puzzle pieces. At least some of the jigsaw puzzle pieces are capable of freely standing in space.

In the exemplary embodiment, the constitutive upstanding walls of the structure have generally planar external and internal surfaces and are so cooperative as to define a box-like enclosure. A generally planar facade depicting the outward appearance of a simulated church is born by the external surface of said constitutive upstanding walls. The upstanding walls are constituted as plural jigsaw puzzle pieces, a unitary roof, composite tower, and working doors and windows are provided. Right angled corner pieces having interfitting interlocking jigsaw shaped peripheral portions are provided for joining the upstanding side walls into a free-standing form.

DETAILED DESCRIPTION OF THE DRAWINGS

Other objects, aspects, advantages and uses of the present invention will become apparent as the invention becomes better understood by referring to the solely exemplary detailed disclosure thereof, wherein:

FIG. 1 of the drawings is a perspective view illustrating an embodiment of a novel jigsaw puzzle building according to the present invention;

DETAILED DISCLOSURE

Figure 1:
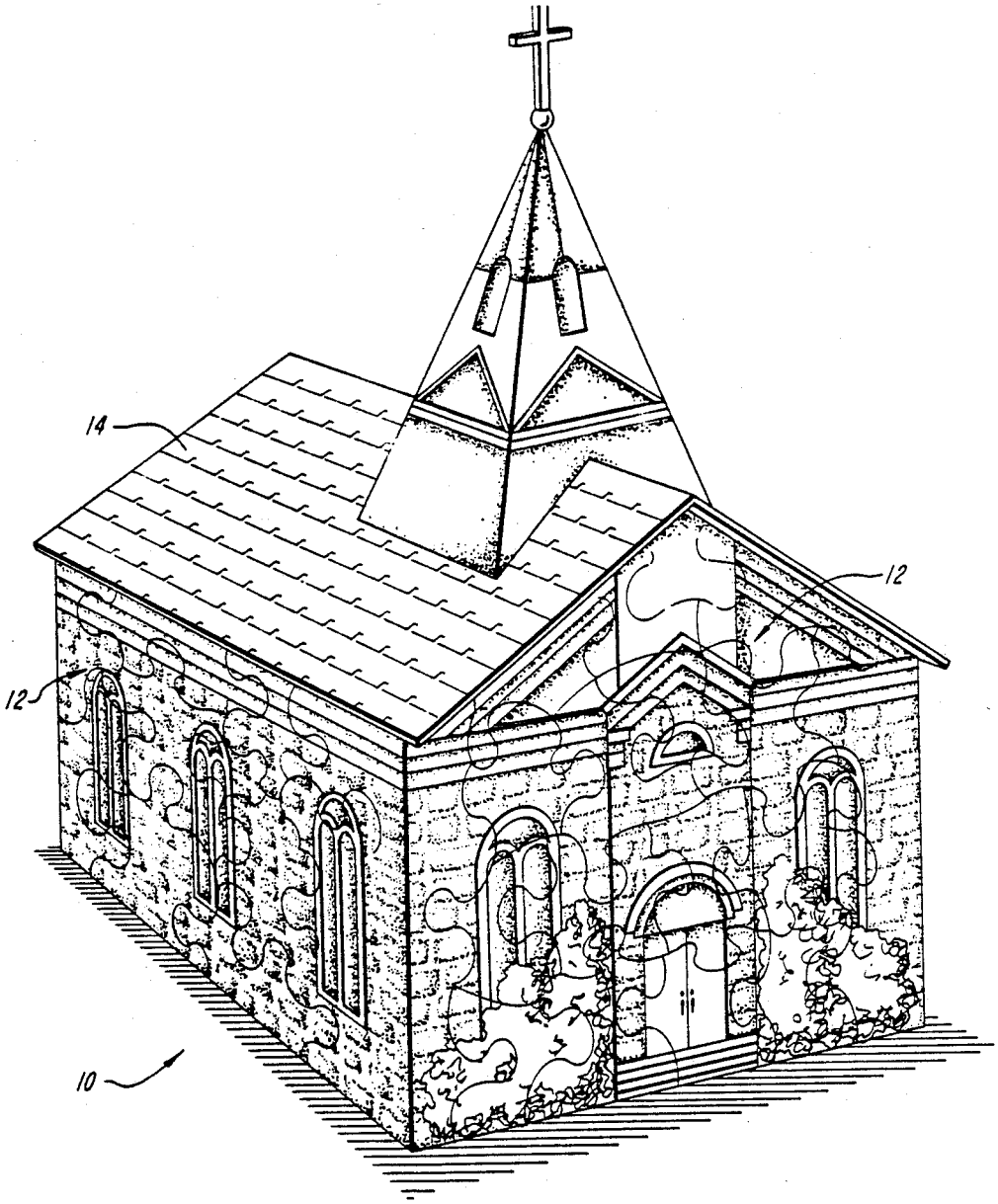

Referring now to FIG. 1, generally designated at 10 is a perspective view illustrating an exemplary embodiment of a puzzle building constructed according to the present invention. The puzzle building 10 in the illustrated embodiment simulates a typical peaked roof New England church, having four walls generally designated 12 that are upstanding, and a peaked roof 14 spanning the top of the enclosure defined by the four upstanding side walls. The hollow puzzle building 10 is self-standing in a manner to be described, and has an image on its exterior surface that represents a particular New England church. Of course the form and the image are selectable to simulate any intended structure, whether that structure is historical structure, the house next door, or any other self-supporting free-standing three-dimensional structure having an exterior and an enclosure defined on the inside, such as castles, fortresses, space ships, buildings, items of use, technological objects, and the like.

The puzzle building 10 is scalable to any intended size.

The four walls 12 and roof 14 are viewable from any direction, simply by walking round the structure.

Doors and windows to be described are selectively placeable in the puzzle piece walls to be described, whereby the interior of the structure may be both viewed, and in dependence on the relative scale, even entered.

The upstanding walls 12 are constituted by puzzle pieces and are joined together by puzzle joining and support pieces to be described so cooperative that the puzzle structure is self-supporting in the assembled condition. The term "self-supporting" herein referes to the characteristic that puzzle structures constructed in accordance with the present invention are able to and do freely stand, due to the cooperation of the several puzzle wall pieces and the puzzle joining and support pieces, but without any other structures auxiliary thereto.

In the nonassembled condition, the puzzle structure is in its collapsed condition, where it occupies comparatively little space. Moreover, insofar as all that needs to be stored are the puzzle pieces, roof, and any building ornamentation, but, nothing else, because of its self supporting characteristic, storage space occupation is minimized.

Figure 2:
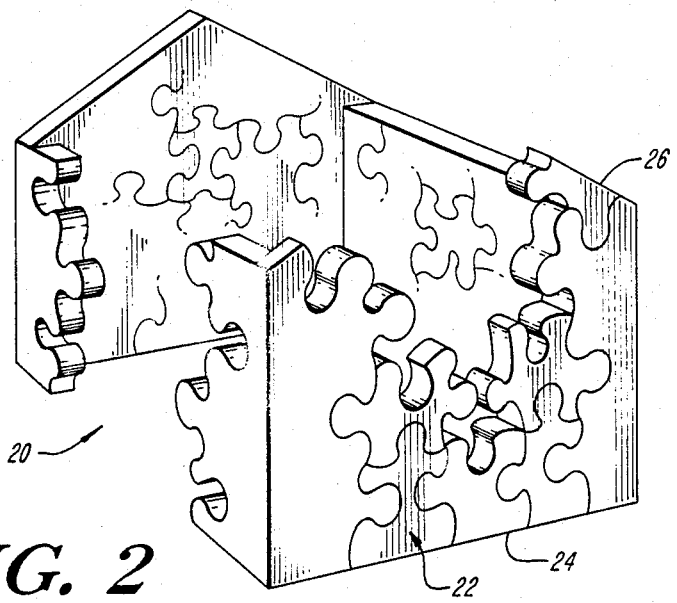
FIG. 2 is a plurality broken away perspective view thereof.

Referring now to FIG. 2, generally designated at 20 is a perspective view of the puzzle building of FIG. 1 at a phase of assembly prior to full completion. The upstanding side walls of the structure 20 each includes plural puzzle wall pieces generally designated 22. The boundaries of the pieces 22 each having one or more projecting portions and one or more recessed portions, which portions are cooperative with the complementarily shaped portions of adjacent puzzle pieces to so interfit that they releasably interlock in a well known jigsaw puzzle manner. Herein, the term "jigsaw" always refers to such interfitting interlocking shapes. Any suitable jigsaw shape known to those skilled in the art can of course be utilized without departing from the inventive concept.

The outer surface of each of the puzzle wall pieces 22 has thereon a unique portion of an image or picture that represents the outward appearance of the corresponding portion of the actual structure that the puzzle building of the present invention is intended to model.

The puzzle wall pieces 22 that belong along the bottom or floor of the several walls, as well as those puzzle wall pieces that belong near the ceiling at the tops of the several walls, have a planar boundary portion 24, 26 at the respective puzzle wall piece to the floor or ceiling interface. The boundaries 24, 26 of each of the several floor and ceiling puzzle pieces provide bearing surfaces for supporting the several pieces off of the floor in their upright position and for supporting the roof placed thereupon respectively. It should be noted that the floor puzzle pieces bear directly upon the confronting surface of the floor of the room in which the puzzle is being assembled, and are self-standing thereupon. The roof in the illustrated embodiment is frictionally supported directly off the planar bearing surface provided by the puzzle pieces adjacent the roof. It is important to note here that the present invention retains the "natural" assembly characteristic of the heretofore two-dimensional puzzles insofar as puzzle pieces and only puzzle pieces are required which superceeding the two-dimensional puzzles by first making possible the spacial experience of the novel three-dimensional jigsaw structure of the invention.

Figure 3:
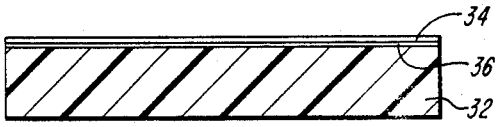
FIG. 3 is a sectional diagram illustrating a preferred emnbodiment of a puzzle piece of the puzzle building according to the present invention.

Referring now to FIG. 3, generally designated at 30 is a sectional diagram in side elevation illustrating the preferred construction of each of the puzzle pieces constituting the upstanding walls of the free standing puzzle building according to the present invention. Each puzzle piece 30 includes a body 32 the thickness of which is selected such that when the corresponding piece is up-ended it is able to stably remain in the upright position. In the preferred embodiment, the body 32 is a multicellular foamed material, commercially available from the 3-M Company, which material, as is well known, is rugged, durable, lightweight, and nontoxic.

A thin, planar sheet 34 capable of receiving and retaining on its outer surface an image, such as of a plastic material or of a paper material, is laminated to the body 32 by an adhesive 36 or other suitable means. A laminated puzzle piece structure as illustrated is exemplary only, since the puzzle pieces may as well be unitary, or otherwise structured, subject only to the requirement that they be lightweight, have sufficient width to support themselves when placed on edge, and be capable of receiving and retaining an image on the external surfaces thereof. It should be noted that while in the presently illustrated embodiment the external surfaces and the internal surfaces of the several puzzle pieces are generally planar, the form is selectable and non-planar shapes are within the scope of the invention.

Figure 4:
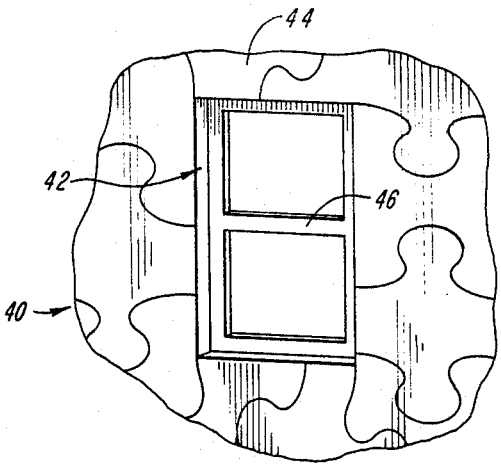
FIG. 4 is a partial pictorial diagram illustrating a window structure in accordance with the invention.

Referring now to FIG. 4, generally designated at 40 is a fragmentary pictorial view illustrating one embodiment of a window/opening structure in accordance with the puzzle building of the present invention. An opening generally designated 42 is defined through the wall constituted by the several puzzle pieces 44, which opening 42 is dimensioned to slideably receive a miniature casement window 46, that may be fabricated out of plastic or other suitable materials. The window 46 is inserted into the opening 42 defined by the cooperative puzzle-pieces 44 after completion of the building structure, or at least after the wall in which the window is to be placed has been assembled. The boundaries of the several puzzle pieces 44 defining the opening 42, like the edges of the floor and ceiling puzzle pieces, are generally planar, but as will be appreciated, if, for example, a circularly shaped "rose" window is being received thereby, as in a puzzle-building of the Chartre Cathedral, the corresponding surfaces of the window receiving puzzle-pieces would be curved. In general, the requirement, of course, is that the outer periphery of the window element correspond in shape to the boundary defined by the cooperative edges of the constitutive puzzle pieces defining the window opening.

Figure 5:
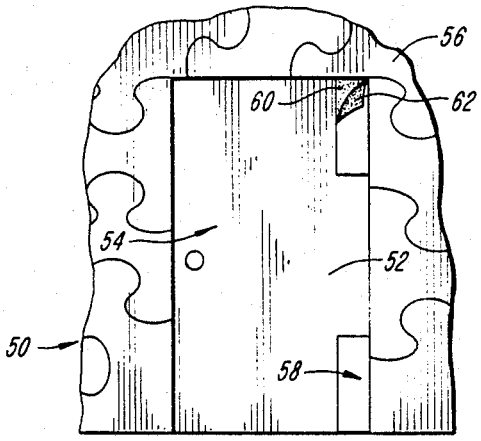
FIG. 5 is a partial pictorial diagram illustrating one door structure of the jigsaw building according to the present invention.

Referring now to FIG. 5, generally designated at 50 in a pictoral diagram illustrating one presently preferred embodiment of a door/opening structure of the puzzle building according to the present invention. A plastic, paper, or other suitable material door member 52 dimensioned so as to fit in an opening generally designated 54 defined by corresponding cooperative puzzle-pieces 54 surrounding and thereby defining the openings 54 is pivotally mounted into the opening by pivots generally designated 58. The pivots 58 are hinges constituted by complementary hook and eye fasteners 60, 62 respectively mounted to the door 52 and to the corresponding one of the puzzle pieces 56. Again, after puzzle building assembly, or at least after assembly of the corresponding wall in which the door is to be located, the door 52 is slidably inset into the opening 54 provided therefor, and is pivotally attached thereto by securing the elements 60, 62 of the hinges 58 into releasable fastening relation. The door 52 can then be opened and closed as is the case with the actual door being simulated by the puzzle building of the invention, and, at the time of puzzle disassembly and storage, the door 52 is simply disconnected by releasing the separable fasteners 58.

Figure 6:
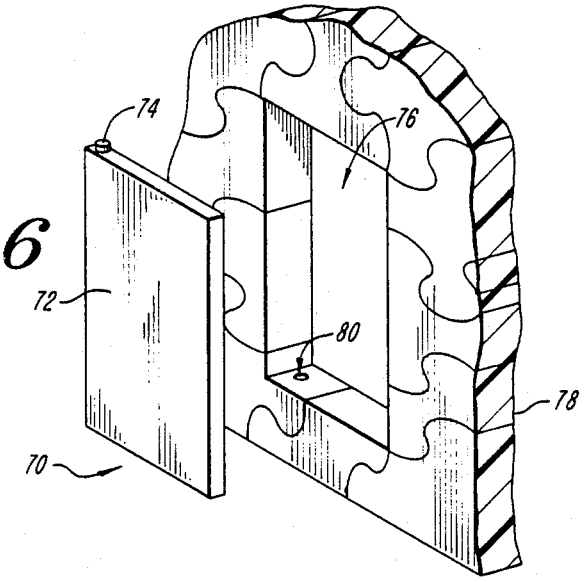
FIG. 6 is a partial, perspective diagram illustrating another door structure of the jigsaw building according to the present invention.

Referring now to FIG. 6, generally designated at 70 is a pictorial diagram illustrating a further door embodiment in accordance with the present invention. A door 72 having hinge posts 74 projecting thereout on either end is inserted into an opening generally designated 76 provided therefor and defined by the boundaries of the corresponding constitutive jigsaw puzzle pieces 78. The door 72 is retained in the opening 76 by the engagement of the hinge posts 74 in bearings generally designated 80 provided in the confronting surfaces of the puzzle pieces defining the opening 76. The bearings 80 in the preferred embodiment can simply and expeditiously be fabricated as a hollowed-out region in the appropriate puzzle-pieces 78. Other structural members than the doors and windows specifically illustrated are contemplated.

Figure 7A:
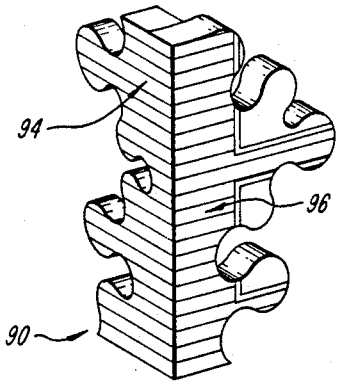
FIG. 7 illustrates in FIGS. 7-A and 7-B thereof a corner jigsaw structure of the jigsaw building according to the present invention.
Figure 7B:
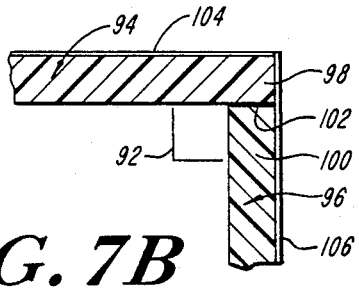

Referring now to FIG. 7, generally designated at 90 in FIG. 7-A is a perspective view illustrating a corner support column having jigsaw puzzle interfitting male and female edges that supports and joins the adjacent upstanding walls of the puzzle building according to the present invention. The column 90 extends for a height that corresponds to the height of the several upstanding walls of the puzzle building of the present invention. The corner support column members 90 have a right-angled cross section, designated 92 in FIG. 7-B, which insures that the walls are joined at their several corners in such a way that they are substantially free from separation in directions away from the corners along the planes of each of the constitutive side walls. The male/-female interfitting peripheral edges of the corner jigsaw pieces 90 mate with the complementary portions of the pieces that thereinto of the adjacent walls.

The corner puzzle members 90 is constituted by first and second upstanding puzzle pieces generally designated 94, 96 so joined at their confronting ends along the corner edge that the images respectively provided to the outsides thereof are continuous across the corner edges. Any suitable means for securing the constitutive corner puzzle pieces 94, 96 together in such a way as to provide a right-angled cross section while preserving the continuity of the images may be employed.

In the illustrated embodiment as best seen in FIG. 7-B, the pieces 94, 96 constituting the corner 90 are shoulder-cut rabbet jointed, although other joints such as a lap joint, among others, are well within the scope of the inventive concept. The backing 98 of the member 94 extends into a recess, or cut-out provided therefor in the backing 100 of the piece 96, and are joined together as by an adhesive schematically illustrated by a darkened line 102 provided in the interface defined by the confronting surfaces thereof. In this way, as is clearly evident in FIGS. 7-A and 7-B, the image bearing layer 104 of the member 94 is contiguous at the corner edges with the image bearing layer 106 of the member 96, so that at the corner edges defined thereby, the image continuously wraps from external wall surface to external wall surface without visual disruption.

Figure 8:
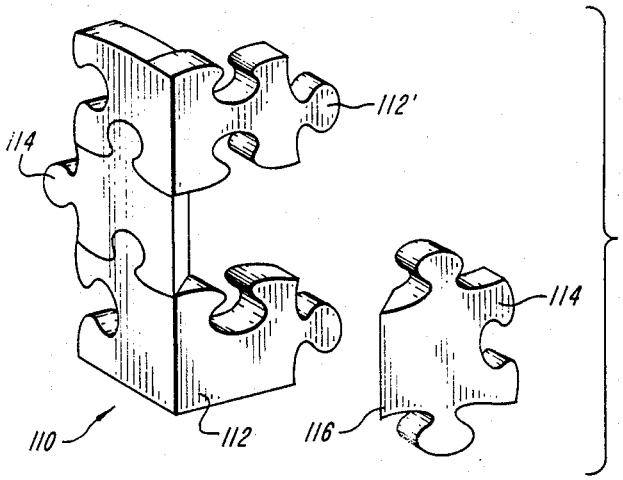
FIG. 8 is a perspective diagram illustrating another embodiment of the corner jigsaw structure of the present invention.

Referring now to FIG. 8, generally designated at 110 is an alternate corner puzzle piece structure of the puzzle-building according to the present invention. The embodiment of the corner piece 110 of FIG. 8 differs from that of the FIG. 7 embodiment in that one or more right-angled corner puzzle pieces 112, 112' are provided in vertically spaced relation, where the corner pieces 112, 112' each have constitutive first and second portions edge-jointed in the manner described above in connection with the description of FIG. 7. Puzzle wall pieces 114 that interfit with these corner puzzle pieces are the same as regular puzzle pieces, except that they are provided with an edge 116 along the corner that mates with the confronting edge of an adjacent piece, so that the images of the two wall pieces at the corner wrap continuously therearound. The pieces 114 have male/female interfitting boundary portions that fit into and mate with corresponding complimentary portions in the vertically spaced corner pieces 112, 112'. The pieces 112, 112' as in the FIG. 7 embodiment both join the adjacent side walls together as well as provide an upright support function by vertical load transfer between the pieces 112, 112' via the corner puzzle pieces 114. While any number of right-angled corner pieces 112, 112' may be provided, their number must always be such that the right-angled corner pieces and the one or more layers of corner jigsaw wall pieces 114 extend the full height of the walls constituting a building-puzzle constructed in accordance with the invention.

Figure 9:
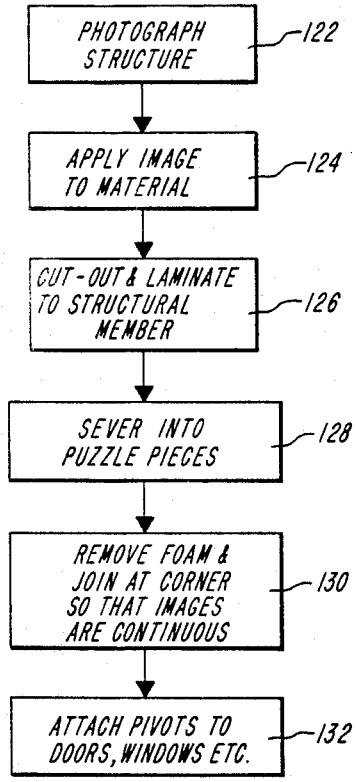
FIG. 9 is a diagram illustrating a presently preferred method of providing a jigsaw building according to the present invention.

Referring now to FIG. 9, generally designated at 120 is a process diagram useful in explaining the method of providing a puzzle-building in accordance with the present invention. As shown by a block 122, an image of the structure or other geometrical/architectural object to be reproduced as a puzzle-structure is photographed or otherwise captured in a form permitting duplication of the image.

As shown by a block 124, the image is applied to an image bearing material such as by printing it on a sheet of flexible MYLAR. In dependence on the selected scale of the intended jigsaw structure and on the comparative size of the selected applying station, several images can be printed on the same sheet at once, such as the four upstanding side walls, the roof, and the steeple of the exemplary puzzle-building.

As shown by a block 126, the printed material is cut-out, and the several cut-outs are laminated as by adhesives to correspondingly sized foamed structural backing members.

As shown by a block 128, the particular blocks of mylar laminated to foam are cut-out using any suitable means, such as a die, manually, a water jet, or by laser cutting, among other techniques, into plural puzzle pieces, where the peripheral shape of the edges thereof is limited only by the requirement that the several pieces be interfitting and interlocking, and in such a way that the image is continuous across adjacent pieces.

As shown by a block 130, the foam located at the corner or at the edge of the pieces forming the corner pieces is removed on one of the pieces, and the corner pieces are joined along the interfacial edge thereof, insuring that the images of the several outer surfaces are continuous.

As shown by a block 132, the type of pivot selected is then joined to the puzzle pieces constituting the corresponding door, window, or other opening piece in the puzzle.

While the invention has been described with respect to the exemplary puzzle building of the invention, its principles extend and include all free-standing puzzle structures having outside and inside surfaces defining an enclosed region therewithin, where the constitutive walls thereof consist of plural jigsaw puzzle pieces, at least some of which are capable of standing stably when placed on edge, and where all of the pieces in the assembled condition define a self-standing jigsaw structure.

Accordingly, the applicant limits its patent right as appears in the following claims.

What is claimed is:

1. A jigsaw puzzle assemblable into a three dimensional building-like structure having walls joined by corners, comprising:

plural jigsaw puzzle wall pieces capable of interlocking in a vertical plane to form at least one of the walls of the building-like structure, each wall piece having an image bearing outer surface and peripheral male and female shapes which are capable of interlocking in said vertical plane with complimentary peripheral male and female shapes of other wall pieces to form a portion of the wall;

plural, self-standing, unitary jigsaw puzzle corner pieces capable of forming the corners of the building-like structure, each corner piece capable of completely forming one of the corners of the building-like structure, each corner piece having a vertical height which is the full vertical height of the walls joined by the corner, each corner piece having peripheral male and female shapes which are capable of interlocking in a vertical plane with complimentary peripheral male and female shapes of some of said wall pieces, and each corner piece further comprised of first and second corner piece members, each member having an image bearing outer surface and joined substantially at a right angle to provide a substantially gap-free corner edge;

said plural puzzle wall pieces and said plural puzzle corner pieces being cooperative to form the building-like structure when all of said wall pieces and said corner pieces are correctly interlocked together;

said plural puzzle wall pieces and said plural puzzle corner pieces having a thickness dimension selected to be sufficient to stably support the building-like structure without aid when said wall pieces and said corner pieces are correctly interlocked together; and said image bearing outer surfaces collectively providing a visually continuous image on the walls and around the corners of the building-like structure when said plural puzzle wall pieces and said plural puzzle corner pieces are correctly interlocked together.

2. The puzzle of claim 1, wherein said jigsaw puzzle wall pieces are each comprised of a composite of permanently-joined components.

3. The jigsaw puzzle of claim 2, wherein said composite jigsaw puzzle wall pieces include a self-supporting backing laminated to an image bearing layer.

4. The jigsaw puzzle of claim 1, wherein said first and second corner piece members of said self-standing jigsaw puzzle corner pieces are each comprised of a composite of permanently-joined components.

5. The jigsaw puzzle of claim 4, wherein said composite first and second corner piece members include a self-standing backing layer laminated to an image bearing layer.

6. The jigsaw puzzle of claim 1, wherein said first and second corner piece members are jointed with a shoulder-cut rabbet joint.

7. The jigsaw puzzle of claim 1, further including means for providing a roof.

8. The jigsaw puzzle of claim 7, wherein said roof is comprised of components other than jigsaw puzzle pieces.

9. The jigsaw puzzle of claim 1, further including means for providing a door.

10. The jigsaw puzzle of claim 1, further including means for providing a window.

11. The puzzle of claim 1, further including building ornamentation.

12. The puzzle of claim 1, wherein said corner piece members are integrally formed.

13. A three dimensional building-like structure disassemblable into a plurality of each puzzle pieces, comprising:

a plurality of walls, each wall further comprising a plurality of jigsaw puzzle wall pieces interlocked in a vertical plane, each wall piece having an image-bearing outer surface and peripheral male and female shapes which interlock in said vertical plane with complementary peripheral male and female shapes of other wall pieces to form a portion of said wall;

a plurality of corners joining said walls, said corners further comprising a plurality of self-standing, unitary jigsaw puzzle corner pieces, each corner piece completely forming one of said corners, each corner piece having a vertical height which is the full vertical height of said walls joined by said corner, each corner piece having peripheral male and female shapes which interlock in a vertical plane with complementary peripheral male and female shapes of some of said wall pieces, and each corner piece further comprised of first and second corner piece members each having an image bearing outer surface and joined substantially at a right angle to provide a substantially gap-free corner edge;

said plural puzzle wall pieces and said plural puzzle corner pieces having a thickness dimension sufficient to stably support the building-like structure without aid when said wall pieces and said corner pieces are correctly interlocked together; and said image bearing surfaces collectively providing a visually continuous image along said walls and around said corners when said jigsaw puzzle wall pieces and said jigsaw puzzle corner pieces are correctly interlocked together.

14. The jigsaw puzzle structure of claim 13, wherein said structure is further comprised of a roof assembled from components other than jigsaw puzzle pieces.

* * * * *